US005443749A

United States Patent [19]

Dotolo

[11] Patent Number: 5,443,749

[45] Date of Patent: Aug. 22, 1995

[54] GLOVE DYE STAIN REMOVER

[75] Inventor: Vincent A. Dotolo, Clearwater, Fla.

[73] Assignee: Citra Science Ltd., Largo, Fla.

[21] Appl. No.: 284,848

[22] Filed: Aug. 2, 1994

[51] Int. Cl.[6] ..... C11D 10/04

[52] U.S. Cl. ..... 252/170; 252/164; 252/165; 252/166; 252/167; 252/171; 252/174.22; 252/174.23; 252/174.24; 252/DIG. 5

[58] Field of Search ..... 252/164, 165, 166, 167, 252/170, 171, 174.22, 174.23, 174.24, DIG. 5

[56] References Cited

U.S. PATENT DOCUMENTS

| | | | |
|---|---|---|---|
| Re. 33,210 | 5/1990 | Stoufer | 252/153 |
| 2,709,683 | 5/1955 | Sarchet | 252/89 |
| 4,533,487 | 8/1985 | Jones | 252/170 |
| 4,561,991 | 12/1985 | Herbots et al. | 252/118 |
| 4,600,522 | 7/1986 | Grzeskowiak et al. | 252/170 |
| 4,620,937 | 11/1986 | Dellutri | 252/143 |
| 4,767,563 | 8/1988 | de Buzzaccarini | 252/174.25 |
| 5,171,475 | 12/1992 | Freiesleben | 252/312 |
| 5,290,471 | 3/1994 | Greene et al. | 252/108 |
| 5,298,181 | 3/1994 | Choy et al. | 252/95 |
| 5,360,580 | 11/1994 | Dotolo et al. | 252/542 |

FOREIGN PATENT DOCUMENTS

| | | |
|---|---|---|
| 0174711 | 3/1986 | European Pat. Off. . |
| 0269178A2 | 6/1988 | European Pat. Off. . |
| 1603047 | 11/1981 | United Kingdom . |
| WO94/05751 | 3/1994 | WIPO . |

*Primary Examiner*—Paul Lieberman
*Assistant Examiner*—Wyatt B. Pratt
*Attorney, Agent, or Firm*—Donald R. Fraser

[57] ABSTRACT

A glove dye stain remover consists of d-limonene, an ionic surfactant, nonylphenol +9 EO polyethoxylate, C-11 alcohol ethoxylate, butylated hydroxytoluene, pumice, and water.

21 Claims, No Drawings

GLOVE DYE STAIN REMOVER

FIELD OF THE INVENTION

This invention relates generally to a glove dye stain remover. More particularly, the invention is directed to a formulation containing, inter alia, d-limonene, which is useful for removing stains from one's hands caused by glove dye bleeding from the gloves onto the skin.

BACKGROUND OF THE INVENTION

In many sporting activities, the participants wear gloves. This is particularly true in the equestrian field, where participants who ride, race, or merely handle horses usually wear leather gloves. During strenuous activity, or inclement weather, the gloves become wet and the dye from the gloves stains the hands of the wearer.

Typical cleaners used for removing stains from one's hands are generally harsh and irritating to the skin. Moreover, most such cleaners are not biodegradable.

It would be desirable to formulate a glove dye stain remover that is effective, non-irritating to the skin, and biodegradable.

SUMMARY OF THE INVENTION

Accordant with the present invention, an effective, non-irritating, biodegradable glove dye stain remover has surprisingly been discovered. The stain remover consists of d-limonene, a surfactant, nonylphenol +9 EO polyethoxylate, C-11 alcohol ethoxylate, butylated hydroxytoluene, pumice, and water.

The glove dye stain remover of the present invention is particularly useful for removing glove dye stains from the hands of glove wearers.

Further objects and advantages of this invention will be apparent from the following description and appended claims.

DETAILED DESCRIPTION OF THE PREFERRED EMBODIMENTS

The glove dye stain remover formulation of the present invention consists of a precise combination of d-limonene, a surfactant, C-11 alcohol ethoxylate, butylated hydroxytoluene, pumice, and water.

D-limonene is a terpene which occurs naturally in all living plants. It is a monocyclic unsaturated terpene which is generally a by-product of the citrus industry, derived from distilled rind oils of oranges, grapefruits, lemons, and the like. A discussion of d-limonene and its derivation from numerous sources is set forth in Kesterson, J. W., "Florida Citrus Oil," Institute of Food and Agriculture Sciences, University of Florida, December, 1971. D-limonene is commercially available from Florida Chemical Company and from SMC Glidco Organics. D-limonene may be present in the inventive formulation at a concentration from about 15 to about 65 weight percent. Preferably, the concentration of d-limonene is about 31 weight percent.

A surfactant is present in the glove dye stain remover of the present invention. Surfactants are well-known as containing molecules comprising groups of opposing solubility tendencies; typically containing an oil-soluble hydrocarbon chain and a water-soluble ionic or polar group. Examples of surfactants include, without limitation, carboxylates, polyalkylene oxides, carboxylic acid esters, quaternary ammonium compounds, and the like. Surfactants are described more fully in Kirt-Othermer, "Concise Encyclopedia of Chemical Technology," John Wiley & Sons, 1985 at pages 1142–1146. A preferred surfactant is sold under the trade name "MONAMINE 1255" by Mona Industries of Paterson, N.J. The surfactant may be present in the instant formulation at a concentration from about 3.5 to about 14.5 weight percent. Preferably, the concentration of the surfactant is about 9.5 weight percent.

Nonylphenol +9 EO polyethoxylate is present in the inventive formulation as a non-ionic surfactant. A preferred nonylphenol +9 EO polyethoxylate may be obtained from Ashland Chemical Company, Columbus, Ohio, having the product designation "IGEPAL CO-630". The nonylphenal +9 EO polyethoxylate may be present at a concentration from about 2.2 to about 11.8 weight percent. Preferably, the concentration is about 5.5 weight percent.

C-11 alcohol ethoxylate is present in the stain remover as a detergent. The concentration of the C-11 alcohol ethoxylate may range from abut 0.03 to about 4 weight percent. Preferably, the concentration is about 1 weight percent. A preferred C-11 alcohol ethoxylate is available from Van Waters & Rogers Inc., Kirkland, Wash., under the trade name "NEODOL 1-5".

Butylated hydroxytoluene, a well-known antioxidant, is used in the present glove dye stain remover. The butylated hydroxytoluene may be present at a concentration from about 0.04 to abut 4.5 weight percent. Preferably, the concentration is about 1 weight percent.

The inventive stain remover additionally contains an abrasive compound, e.g., pumice. The pumice may be present at a concentration from abut 1.5 to about 9.5 weight percent. Preferably, the concentration is about 3.5 weight percent.

Water is added to the instant formulation to make up the balance of the total weight of the stain remover.

The aforesaid ingredients are blended together and mixed in conventional mixing equipment to prepare the glove dye stain remover of the present invention. It may then be utilized in the manner conventionally used for hand cleaners, and is effective for removing glove dye stains from the hands.

EXAMPLE

The following ingredients are mixed and blended together to formulate the glove dye stain remover according to the present invention.

TABLE 1

GLOVE DYE STAIN REMOVER FORMULATION

| Ingredient | Approximate Weight percent |
|---|---|
| d-limonene (1) | 31 |
| ionic surfactant (2) | 9.5 |
| nonylphenol +9 EO polyethoxylate (3) | 5.5 |
| C-11 alcohol ethoxylate (4) | 1 |
| bytylated hydroxytoluene | 1 |
| pumice | 3.5 |
| water | 48.5 |

(1) GLIDSAFE, from SMC Glidco Organics.
(2) MONAMINE 1255, from Mona Industries.
(3) IGEPAL CO-630, from Ashland Chemical Company.
(4) NEODOL 1-5, from Van Waters & Rogers Inc.

This Example may be repeated with similar success by substituting the generically or specifically described ingredients and/or concentrations recited herein for those used in the preceding Example.

From the foregoing description, one ordinarily skilled in the art can easily ascertain the essential characteristics of this invention and, without departing from its spirit and scope, can make various changes and modification to the invention to adapt it to various usages and conditions.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A glove dye stain remover, consisting of:
d-limonene;
an ionic surfactant;
nonylphenol +9 EO polyethoxylate;
C-11 alcohol ethoxylate;
butylated hydroxytoluene;
pumice; and
water.

2. The glove dye stain remover according to claim 1, wherein the d-limonene concentration ranges from about 15 to about 65 weight percent.

3. The glove dye stain remover according to claim 1, wherein the ionic surfactant concentration ranges from about 3.5 to about 14.5 weight percent.

4. The glove dye stain remover according to claim 1, wherein the nonylphenol +9 EO polyethoxylate ranges from about 2.2 to about 11.8 weight percent.

5. The glove dye stain remover according to claim 1, wherein the C-11 alcohol ethoxylate concentration ranges from about 0.3 to about 4 weight percent.

6. The glove dye stain remover according to claim 1, wherein the butylated hydroxytoluene concentration ranges from about 0.04 to about 4.5 weight percent.

7. The glove dye stain remover according to claim 1, wherein the pumice concentration ranges from about 1.5 to about 9.5 weight percent.

8. The glove dye stain remover according to claim 2, wherein the d-limonene concentration is about 31 weight percent.

9. The glove dye stain remover according to claim 3, wherein the ionic surfactant contraction is about 9.5 weight percent.

10. The glove dye stain remover according to claim 4, wherein the nonylphenol +9 EO polyethoxylate concentration is about 5.5 weight percent.

11. The glove dye stain remover according to claim 5, wherein the C-11 alcohol ethoxylate concentration is about 1 weight percent.

12. The glove dye stain remover according to claim 6, wherein the butylated hydroxytoluene concentration is about 1 weight percent.

13. The glove dye stain remover according to claim 7, wherein the pumice concentration is about 3.5 weight percent.

14. A glove dye stain remover, consisting of:
from about 15 to about 65 weight percent d-limonene;
from about 3.5 to about 14.5 weight percent ionic surfactant;
from about 2.2 to about 11.8 weight percent nonylphenol +9 EO polyethoxylate;
from about 0.3 to about 4 weight percent C-11 alcohol ethoxylate;
from about 0.4 to about 4.5 weight percent butylated hydroxytoluene;
from about 1.5 to about 9.5 weight percent pumice; and
the balance, water.

15. The glove dye stain remover according to claim 14, wherein the d-limonene concentration is about 31 weight percent.

16. The glove dye stain remover according to claim 14, wherein the surfactant concentration is about 9.5 weight percent.

17. The glove dye stain remover according to claim 14, wherein the nonylphenol +9 EO polyethoxylate concentration is about 5.5 weight percent.

18. The glove dye stain remover according to claim 14, wherein the C-11 alcohol ethoxylate concentration is about 1 weight percent.

19. The glove dye stain remover according to claim 14, wherein the butylated hydroxytoluene concentration is about 1 weight percent.

20. The glove dye stain remover according to claim 14, wherein the pumice concentration is about 3.5 weight percent.

21. The glove dye stain remover, consisting of:
about 31 weight percent d-limonene;
about 9.5 weight percent ionic surfactant;
about 5.5 weight percent nonylphenol +9 EO polyethoxylate;
about 1 weight percent C-11 alcohol ethoxylate;
about 1 weigh percent butylated hydroxytoluene;
about 3.5 weight percent pumice; and
the balance, water.

* * * * *